United States Patent [19]

Yamamoto et al.

[11] Patent Number: 4,990,963

[45] Date of Patent: Feb. 5, 1991

[54] DEVELOPING MEMBER COMPOSED OF CONDUCTIVE PARTICLES IN A DIELECTRIC MATERIAL AND HAVING A VARIABLE VOLUME RESISTIVITY

[75] Inventors: Masashi Yamamoto; Yuji Enoguchi; Toshiya Natsuhara; Fumio Masuda, all of Osaka, Japan

[73] Assignee: Minolta Camera Co., Ltd. Senri Center, Osaka, Japan

[21] Appl. No.: 221,044

[22] Filed: Jul. 18, 1988

[30] Foreign Application Priority Data

Jul. 16, 1987 [JP] Japan ..... 62-177754

[51] Int. Cl.[5] ..... G03G 15/06

[52] U.S. Cl. ..... 355/259; 29/132; 118/661

[58] Field of Search ..... 355/259; 118/651, 661; 29/131, 132, 130, 121.8, 129.5

[56] References Cited

U.S. PATENT DOCUMENTS

| | | | |
|---|---|---|---|
| 3,950,089 | 4/1976 | Fraser et al. | 118/651 |
| 4,564,285 | 1/1986 | Yasuda et al. | 118/651 |
| 4,696,255 | 9/1987 | Yano et al. | 355/259 |
| 4,827,868 | 5/1989 | Tarumi et al. | 29/130 |

FOREIGN PATENT DOCUMENTS

| | | | |
|---|---|---|---|
| 0062471 | 5/1980 | Japan | 118/661 |
| 0090665 | 5/1983 | Japan . | |
| 0208769 | 12/1983 | Japan | 355/259 |
| 0103370 | 5/1985 | Japan | 355/259 |
| 0118372 | 5/1987 | Japan . | |
| 3705341 | 8/1987 | Japan | 355/259 |

*Primary Examiner*—A. T. Grimley
*Assistant Examiner*—Nestor R. Ramirez
*Attorney, Agent, or Firm*—Wenderoth, Lind & Ponack

[57] ABSTRACT

In an apparatus for developing an electrostatic latent image formed on an electrostatic latent image carrier using a monocomponent developer, a developing member, which makes contact with the electrostatic latent image carrier when the developing member has a coating of monocomponent developer maintained on the surface thereof, incorporates a dielectric material in which conductive particles are dispersed and has a volume resistivity that increases from the direction of the core to the surface.

7 Claims, 6 Drawing Sheets

DEVELOPING MEMBER COMPOSED OF CONDUCTIVE PARTICLES IN A DIELECTRIC MATERIAL AND HAVING A VARIABLE VOLUME RESISTIVITY

BACKGROUND TO THE INVENTION

The present invention relates to a developing member for a developing apparatus used in electrophotographic copy machines and printers, the developing apparatus employing a monocomponent developer comprising toner only.

Conventional developing apparatus which use monocomponent developers are known to supply non-magnetic toner to the surface of a developing roller that functions as a developing member and form a thin layer of charged toner on the circumference of the roller via pressure applied by a blade, this thin layer of charged toner making direct contact with the surface of an electrostatic latent image to produce a toner image.

U.S. Pat. No. 3,754,963 discloses a developing apparatus having a developing surface of minutely refined graphite particles dispersed in a resin.

However, the conductive developing roller achieves poor image density gradation and highly detailed, high density blind spot reproducibility is also poor. Further, when pin hole defects occur on the photosensitive member due to the abnormally strong electric field produced between the grounded photosensitive member and the charged developing roller or when a charge is discharged from the end portion of the developing roller, the bias voltage supplied to the developing roller leaks therefrom, thus reducing the bias voltage, generating uneven density, grainy fog or image dislocation and leading to discharge-induced damage to the photosensitive member.

In contrast, when a highly insulated developing member comprising only a dielectric material or developing member incorporating a minimum of conductive particles is used, density remains unsatisfactory and reproducibility of fine lines and blind spots is poor in spite of the excellent reproducibility of density gradations.

SUMMARY OF THE INVENTION

A main object of the present invention is to provide a developing member that has excellent density gradations and fine line reproducibility for use in a developing apparatus that uses a monocomponent developer.

A further object of the present invention is to provide a developing member that is unlikely to produce leakage or reduction of the developing bias voltage for use in a developing apparatus that uses a monocomponent developer.

To accomplish the aforesaid objects in an apparatus that develops an electrostatic latent image formed on an electrostatic latent image carrier using a monocomponent developer, the present invention provides a developing member which makes contact with the electrostatic latent image carrier when the developing member has a coating of monocomponent developer maintained on the surface thereof, the developing member incorporating a dielectric material in which conductive particles are dispersed, and the developing member being characterized by having a volume resistivity that increases from the the direction of the core to the surface.

The difference in the internal and surface volume resistivities of the developing member of the present invention is regulated mainly by the type of conductive particles, particle size and load. The volume resistivity of the developer carrying member is ideally $10^9$ Ohm-cm or greater in the layer nearest the surface and ideally $10^6$ Ohm-cm or less in the layer most remote from the surface (inner layer). When the volume resistivity of the surface layer is less than $10^9$ Ohm-cm, density gradation, blind spot gradation and fine line reproducibilities deteriorate. On the other hand, when the volume resistivity of the inner layer exceeds $10^6$ Ohm-cm, adequate image density cannot be obtained.

These and other objects, advantages and features of the invention will become apparent from the following description thereof taken in conjunction with the accompanying drawings which illustrate a specific embodiment of the invention.

DETAILED DESCRIPTION OF THE INVENTION

The present invention is hereinafter described with reference to the drawings.

Figure 1:
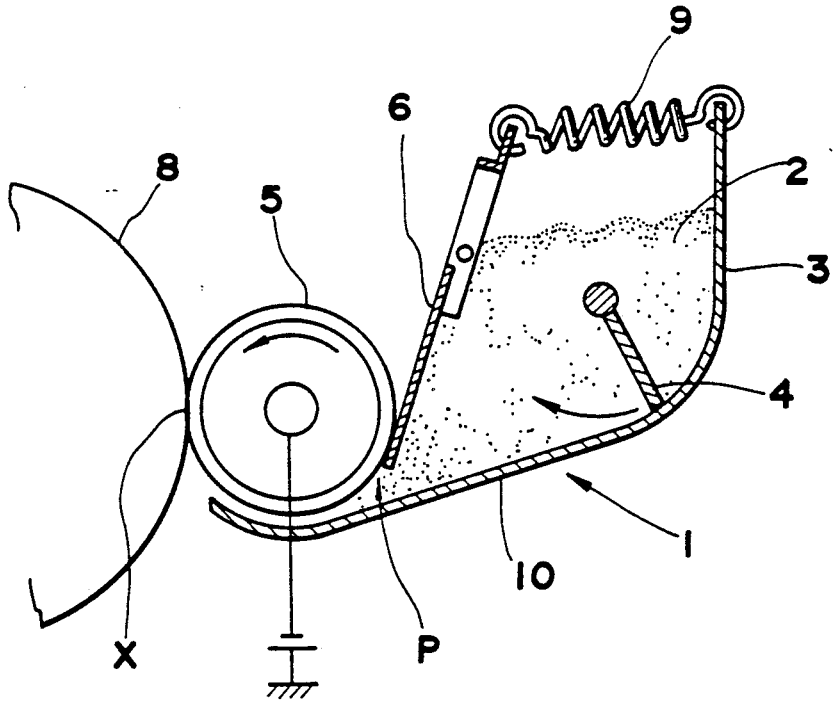
FIG. 1 is a simplified section view showing a single embodiment of the developing apparatus of the present invention.
Figure 2A:
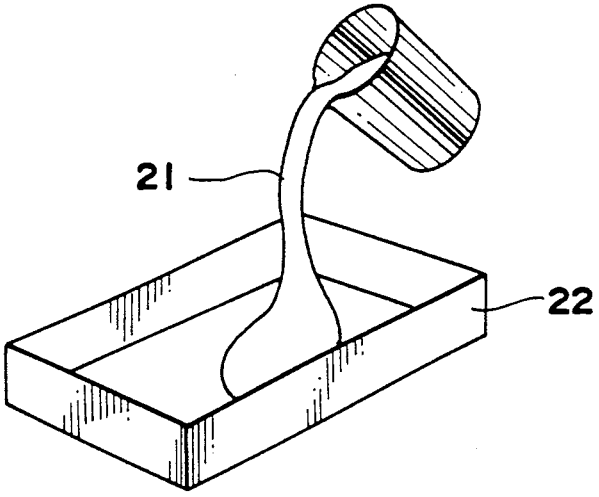
FIGS. 2, 3 and 4 are illustrations showing examples of methods for producing the developing member of the present invention.
Figure 2B:
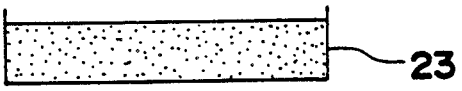
Figure 2C:
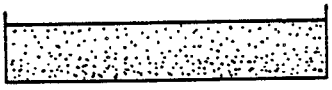
Figure 2D:
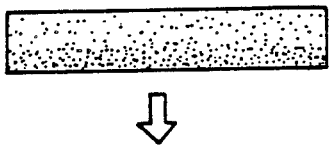
Figure 2E:
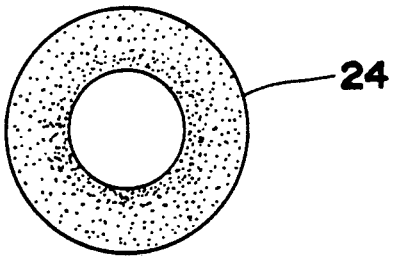

FIG. 1 shows developing apparatus 1 which develops an electrostatic latent image formed on photosensitive drum 8 using a monocomponent developer comprising toner only. The developing apparatus 1 comprises developing roller 5 which is rotated in the counterclockwise direction in the drawing when it is in contact with the photosensitive drum 8, developer thickness regulating member 6 which is pressed to the surface of developer roller 5 by spring 9, casing 3 formed by the developer thickness regulating member 6 and hopper 2, and agitating member 4 which is rotatable within hopper 2.

According to the present construction, the developer accumulated in hopper 2 of developing apparatus 1 is agitated by the rotation of agitating member 4, and is fed to the regulating portion P formed by the surface of developer roller 5 and the developer thickness regulating member 6 pressed thereupon. A charged thin layer of developer is formed on the surface of the developing roller 5 at the regulating portion P, and is carried via the rotation of developing roller 5 to developing region X where the photosensitive drum 8 and developing roller 5 are in contact. At the developing region X, the thin layer of developer maintained on the surface of developing roller 5 comes into contact with the surface of the photosensitive drum 8 and travels to the surface of the photosensitive drum 8 in accordance with the electrostatic latent image charge, thereby rendering visible the electrostatic latent image.

The aforesaid developing roller has a volume resistivity which increases in the direction from the core to the surface. Methods for producing such a developing member are described hereinafter.

(I) As shown in FIG. 2, a low viscosity fluid resin 21 having conductive particles uniformly dispersed therein is poured into a flat-surfaced tray 22. The fluid resin hardens after standing for a fixed period of time. Conductive particles 23 gradually precipitate so as to be more densely dispersed in the bottom portion of the fluid and become less densely dispersed in the direction toward the surface (See FIG. 2(*c*)). Developing roller 24 is obtained after the aforesaid resin material is formed into a cylindrical shape and completely hardened.

Figure 3A:
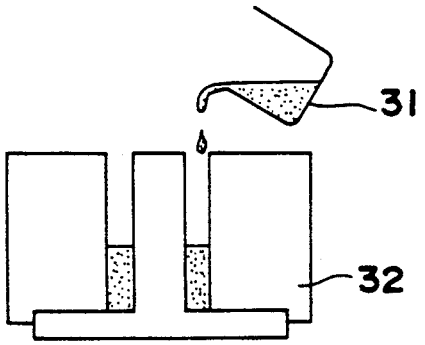
Figure 3D:
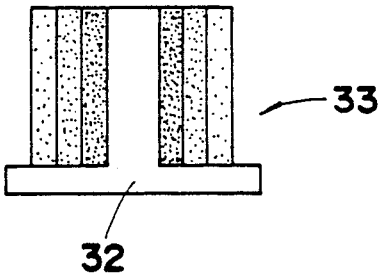
Figure 3B:
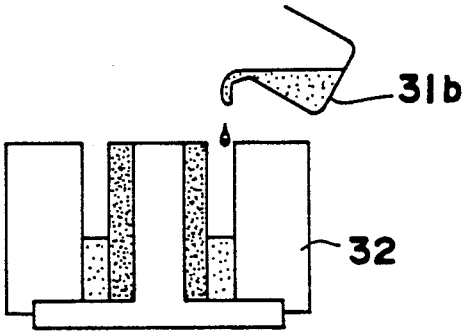
Figure 3E:
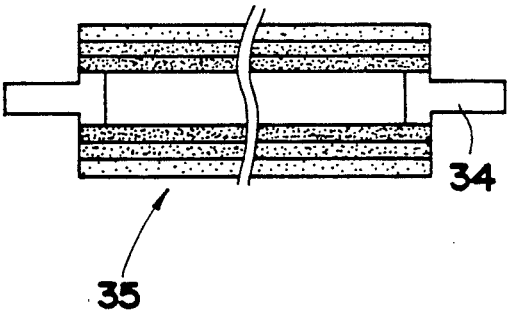
Figure 3C:
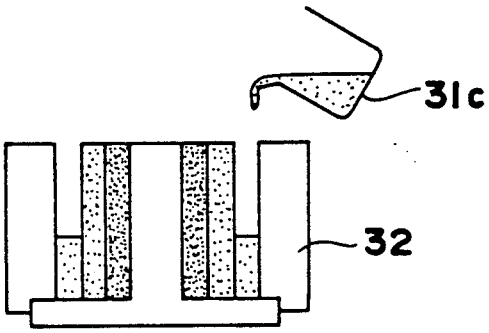
Figure 4A:
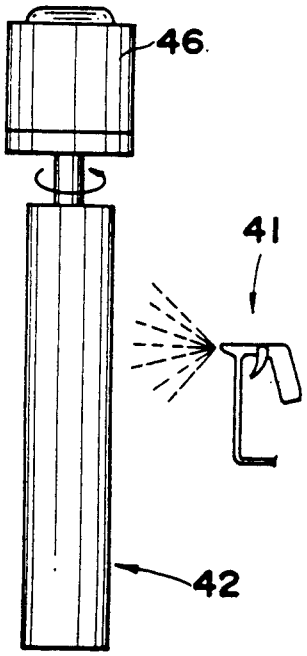
Figure 4B:
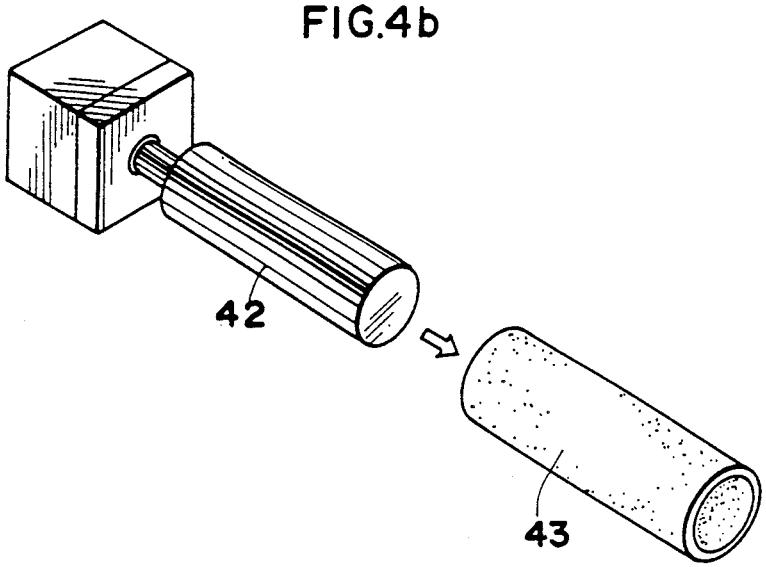
Figure 4C:
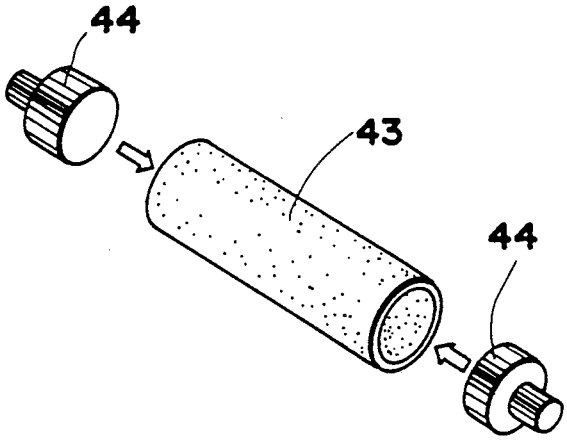
Figure 4D:
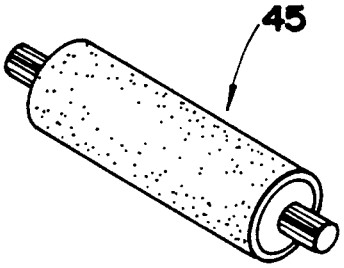
Figure 5A:
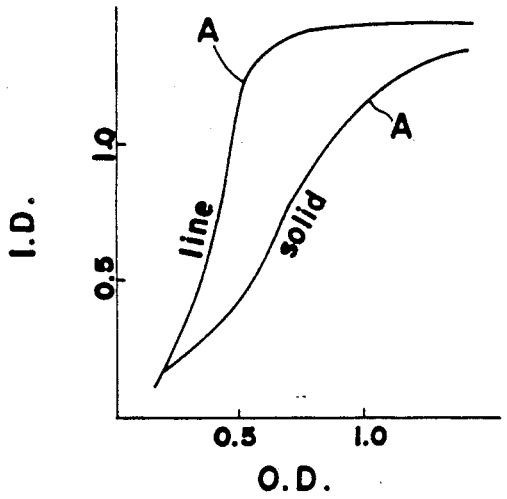
FIGS. 5(*a*), (*b*), (*c*) and (*d*) are graphs showing the relationship between original document density and copy image density.
Figure 5B:
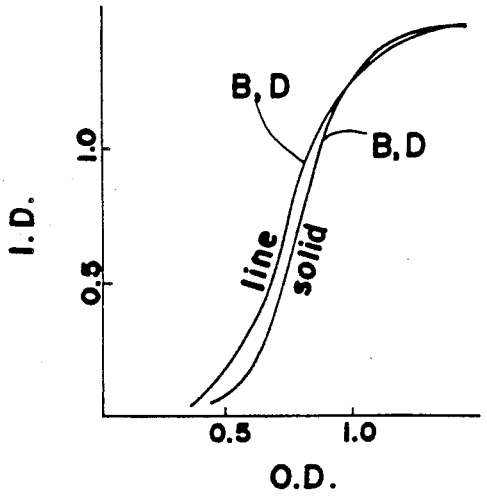
Figure 5C:
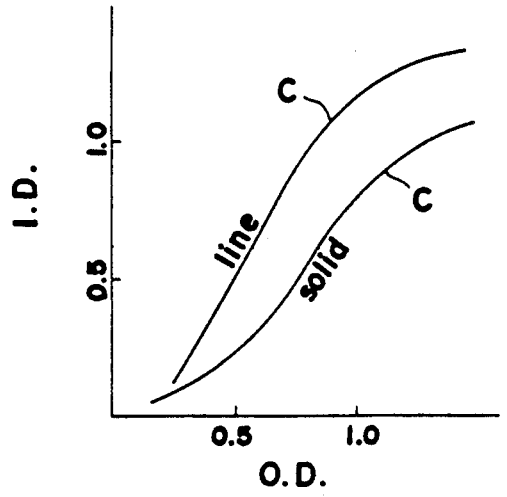
Figure 5D:
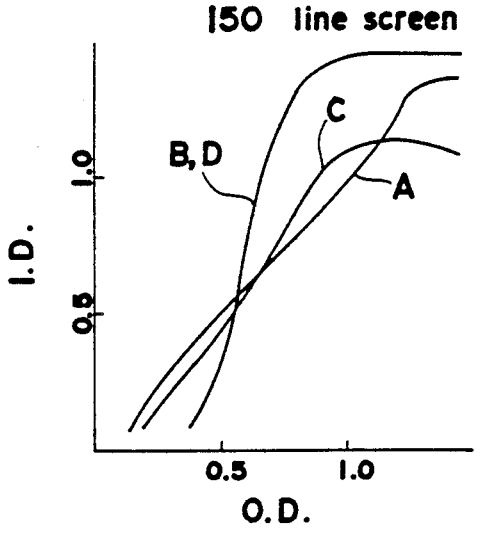

(II) Another method provides for a plurality of resin solutions 31*a*, 31*b* and 31*c* each of which have different loads of conductive particles uniformly dispersed throughout the individual solutions, these solutions being sequentially poured into mold 32 with the solution having the greatest load ratio of conductive particles (i.e., 31*a*) poured first at the core and subsequent solutions having sequentially greater loads in the order b, c. Each layer is hardened in turn (FIGS. 3*a*, 3*b* and 3*c*). A roller 33 is obtained wherein the conductive particles are most dense in the central portion, as shown in FIG. 3*d*, and become less dense in each subsequent layer moving in the direction toward the surface. The member is removed from the mold 32, and shafts are attached to both ends to form the developing member 35 shown in FIG. 3(*e*).

(III) Another method provides for the use of spray device 41, as shown in FIG. 4, wherein a developing roller 45 is obtained by repeatedly spraying fluid resins each having a different load of conductive particles onto a cylindrical mold 42. The fluid resin may also be applied by a spreading method instead of spraying.

(IV) Still another method provides for the use of conductive microparticles 50 to 150 μm in size having a relatively low specific gravity, such as aluminum powder or carbon black, uniformly dispersed in a low specific gravity resin, such as polyethylene, ABS, or polypropylene, these specific gravities being 1.2 or less, the fluid also having a volume resistivity of $10^5$ Ohm-cm or less, and being further uniformly dispersed in another thermoset fluid resin of greater specific gravity. Subsequently, the fluid resin mixture is injected into a cylindrical mold and rotated, thereby loading the conductive particles more densely in the interior center portion and less densely toward the outer surface of the cylinder. The resin is then heated and hardened soon after the mold has been rotated, thereby producing the desired developing roller.

Plastic materials are also useable in the manufacture of the developing roller, for example, phenol resin, epoxy resin, acrylic resin, polycarbonate, polyurethane, melamine resin, acetyl cellulose, polyvinyl alcohol, urea resin vinyl chloride and the like. Useable rubber materials are silicon rubber, neoprene, butadiene and the like.

A material which is weakly chargeable, i.e. which is not triboelectrically charged by the toner or becomes slightly charged but with an opposite polarity to that of the toner, is desirable for use as the conductive member employed in the developing roller. Thus, toner fogging and abnormal developing bias is prevented and satisfactory image density is obtained.

On the other hand, useable conductive particles include carbon black, graphite, bronze powder, aluminum powder, copper powder, silver powder, stainless steel powder, ferrite powder, and conductive carbon fibers. It is desirable from the perspective of dispersion that the size of these particles be 10 to 150 μm at the time of manufacture. The conductive particles should also be uniformly dispersed in the resin so as to produce a volume resistivity of $10^6$ Ohm-cm or less. Other reinforcing agents may also be used in combination.

The surface of the developing roller which acts as the toner carrier may be roughened by a blasting process or the like (Rz: 3 to 20 μm; approximately ¼ to double the average particle size of the toner), or by cutting narrow channels in the axial direction, so as to improve uniform spreading and transportability of the developer.

Further, performing the roughening process of the developing roller in the axial direction counteracts developer unevenness and prevents irregular image density.

EXAMPLE

The invention is concretely described in the following embodiment.

| Resin Solution Composition | Percentage by Weight |
|---|---|
| Epoxy resin (Epicote 1007; Shell Chemical Co.) | 28% |
| Phenol resin (Scadoform L9 (70% solution) Scado-Archer-Daniels N.V.) | 17% |
| Diacetone alcohol (DAA) | 27.5% |
| Xylol | 27.5% |

Conductive microparticles (proprietary name: Wl (a white conductive powder), manufactured by Mitsubishi Metal Corp.) with a particle size of 0.2 μm and specific resistance of approximately 10 Ohm-cm were added to the aforesaid resin solutions (nonvolatile content (40%) converted per 100 parts by weight) at the following rates: (a) 200 parts by weight, (b) 140 parts by weight, and (c) 100 parts by weight, so as to produce three types of resin solutions each of which was sufficiently mixed in a ball mill. Using spray device 41, the solutions were sequentially applied in descending order of conductive particle density to the cylindrical mold 42 which was rotated via motor 46, so as to produce a dry layer 2.2 mm in thickness which was subsequently heated to 150° C. to harden, as shown in FIG. 4. The obtained resin cylinder 43 was removed from the mold 42 (FIG. 4(*b*)), cut to a specified length, and aluminum shafts were attached at both ends (FIG. 4(*c*)) to produce the roller 45 shown in FIG. 4(*d*). The exterior surface of the obtained roller 45 was planed and sanded, then abraded with sandpaper (#600) in the axial direction so as to produce a roller with a surface roughness of Rz = 7 μm in the circumferential direction major diameter of ϕ 25 mm, and thickness of 2 mm. The volume resistivity of said roller was $10^{10}$ Ohm-cm near the exterior surface and $10^{2\text{-}3}$ Ohm-cm near the interior surface.

EXPERIMENTAL EXAMPLES

Roller A: The roller obtained in the example. Roller B: A conductive resin roller having uniformly dispersed conductive microparticles and obtained by spraying only resin solution (a) of the example (volume resistivity $10^3$ Ohm-cm).

Roller C: An insulated resin roller having only the resin solution of the example (not including conductive particles) applied to an aluminum cylinder so as to form a resin layer.

The cylinder was heated to 200° C. for 5 min after application of the resin, then a second application of resin was made in a similar process while the first application was in a semi-hardened state so as to form a 2 mm thick resin layer having a volume resistivity of $10^{14}$ Ohm-cm.

Roller D: A cylindrical aluminum roller.

The aforesaid rollers all had major diameters of $\phi$ 25 mm, and their surfaces were roughened in the same manner to produce a surface roughness of Rz=7 μm.

The aforesaid four rollers were installed in an electrophotographic copy machine provided with a developing apparatus as shown in FIG. 1. Image density reproducibility for 0.5 mm width lines, 3×4 cm solid and 150 line screen blind spot were checked using a nonmagnetic monocomponent developer. Densities were measured using reflection densitometers. Blind spots and solid densities were measured using a Model DM-272 (Dainippon Screens, Ltd.) and line density was measured using a Sakura Densitometer Model PDM5 type BR (Konishiroku Photo Industry Co., Ltd.).

Developing was conducted under conditions described hereinafter.

Photosensitive member initial surface potential: −400 to −800 volts

Developing bias: −100 to −300 volts

Toner charge: +15 to 20 μC/g

Photosensitive member: Organic photosensitive member (negative charge laminate layer type)

Developer: nonmagnetic monocomponent high-resistance toner (positively charged toner)

FIGS. 5(*a*) through 5(*d*) show the relationship between the original document density (OD) and copy image density (ID). FIGS. 5(*a*) through 5(*c*) show the results for the fine line image and solid image, and FIG. 5(*d*) shows the result for blind spot image.

As indicated in FIGS. 5(*a*) and 5(*d*), roller A was excellent in low density line reproduction and solid tone reproduction, and accurately reproduced blind spot images. As shown in FIGS. 5(*b*) and 5(*d*), rollers B and D displayed poor solid tone quality, and did not reproduce low density lines or solids. Low density blind spot images were not reproduced and high density solids were completely blackened; these rollers did not accurately reproduce images. As shown in FIGS. 5(*c*) and 5(*d*), roller C displayed excellent tone quality, but did not produce sufficient image density, and line density was also unsatisfactory. Blind spot image tone quality was superior, but image density was saturated.

The aforesaid examples, although described in terms of cylindrical developing rollers, are not limited to this configuration and may be in the form of an endless belt.

Figure 6:
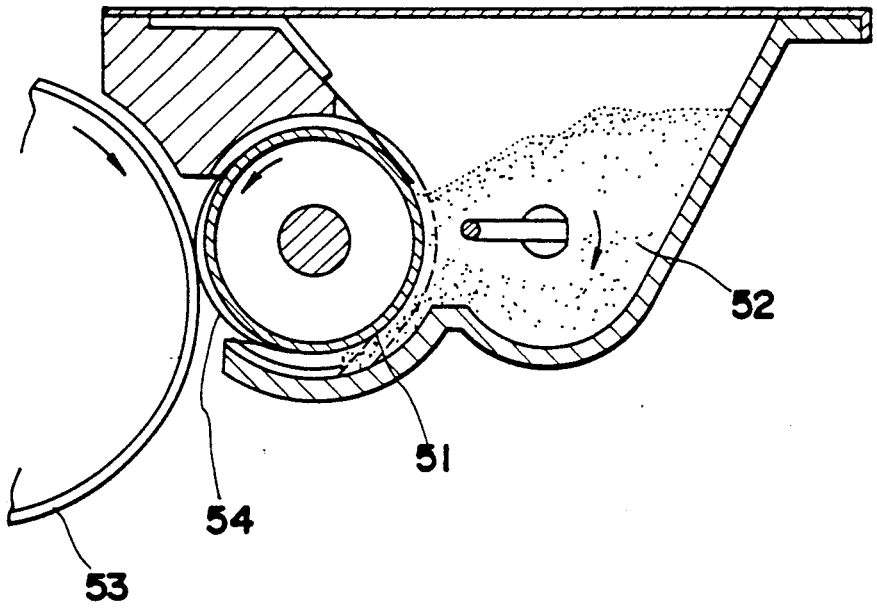
FIGS. 6 and 7 are simplified section views showing further embodiments of the developing member of the present invention.
Figure 7:
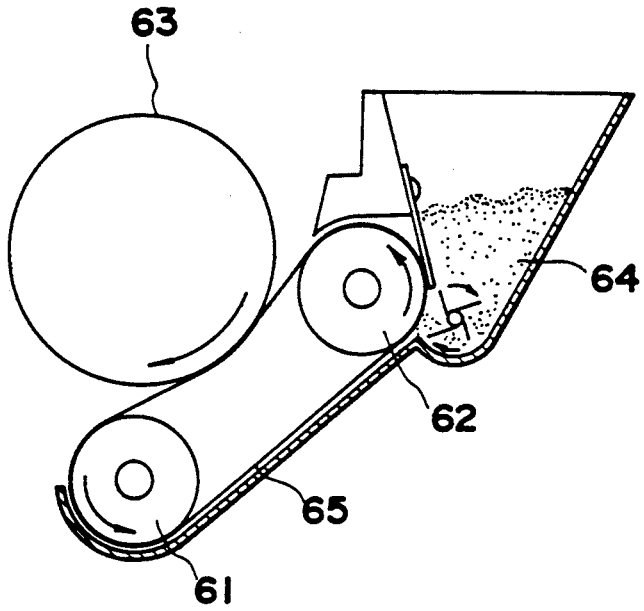

For example, an endless belt developer carrying member 54 having a slightly longer circumference than the roller 51 may be wrapped around a single shaft driven roller 51, the developer 52 being carried by the surface of said belt and supplied to the photosensitive member 53, as shown in FIG. 6. Further, an endless belt developer carrying member 65 may supply developer 64 to photosensitive member 63 when installed between a roller set 61 and 62.

When developer is carried by the surface of the developing member of the present invention as described previously, excellent density gradation, and line and blind spot reproducibility are obtained, thereby producing high quality images having satisfactory image density. Further, developing bias voltage leakage or reduction are not produced, thus preventing the generation of zonal density unevenness and grainy fog.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a developing apparatus for developing an electrostatic latent image formed on a photosensitive member with a monocomponent developer, said apparatus comprising:

a developing member adapted to be disposed adjacent to the photosensitive member, and said developing member retaining the monocomponent developer on a surface to develop the latent image, said developing member being formed of a dielectric material of a predetermined thickness in which conductive particles are dispersed and having a volume resistivity which increases in the direction of said thickness toward said surface.

2. A developing apparatus as in claim 1, wherein said developing member has a volume resistivity of less than $10^6\Omega$.cm in a portion most remote from the surface in the direction of said thickness and a volume resistivity of greater than $10^9\Omega$.cm in a portion nearest said surface of said developing member.

3. A developing apparatus as in claim 2, wherein said developing member includes a layer of said dielectric material formed over a base and said conductive particles are more densely dispersed in a portion of said layer close to said base and less densely dispersed in a portion of said layer nearest said surface.

4. A developing apparatus as in claim 2, wherein said developing member includes a plurality of layers of said dielectric material formed over a base, with said conductive particles dispersed in each said layer, said conductive particles being dispersed more densely in one of said layers closest to said base and less densely in one of said layers nearest said surface.

5. An apparatus for developing an electrostatic latent image, comprising:

a developing member, said member having an outer surface adapted to carry a developer, and an inner surface, and said developing member having a predetermined volume resistivity which increases from said inner surface to said outer surface, whereby a point within said member between said inner and said outer surfaces has a volume resistivity value higher than said inner surface and lower than said outer surface.

6. An apparatus as in claim 5, wherein said developing member is formed of a dielectric material having conductive material dispersed therein.

7. An apparatus as in claim 5, wherein said developing member is a flexible endless belt, and further comprising means for mounting said belt with a slack portion thereof adapted to confront a latent image carrying member.

* * * * *